United States Patent [19]

Solimine

[11] 4,159,830

[45] Jul. 3, 1979

[54] WHEEL TRUCK FOR STEERABLE PLATFORM

[75] Inventor: John S. Solimine, San Francisco, Calif.

[73] Assignees: Fausto Vitello; Eric L. Swenson, both of San Francisco, Calif.

[21] Appl. No.: 826,982

[22] Filed: Aug. 23, 1977

[51] Int. Cl.[2] ..... A63C 17/02

[52] U.S. Cl. ..... 280/11.28; 280/87.04 A

[58] Field of Search ..... 280/11.28, 11.27, 87.04 A

[56] References Cited

U.S. PATENT DOCUMENTS

| | | | |
|---|---|---|---|
| D. 200,917 | 4/1965 | Markham | 280/87.04 A |
| 2,490,849 | 12/1949 | Wagner | 280/11.28 |
| 2,547,796 | 4/1951 | Swensson | 280/11.28 |
| 2,653,821 | 9/1953 | Ware | 280/11.28 |
| 2,739,819 | 3/1956 | Stoner | 280/11.28 |
| 2,744,759 | 5/1956 | Sternbergh | 280/11.28 |

FOREIGN PATENT DOCUMENTS

| | | | |
|---|---|---|---|
| 845975 | 8/1960 | United Kingdom | 280/11.28 |

*Primary Examiner*—David M. Mitchell

*Attorney, Agent, or Firm*—Flehr, Hohbach, Test, Albritton & Herbert

[57] ABSTRACT

A wheel truck for a steerable platform such as a skateboard. The wheel truck includes a base frame mounted below the platform and carrying a vertical support shaft and downwardly inclined steering shaft. An axletree upon which wheels are mounted is carried from the frame by resilient support means. The support means includes pairs of elastomeric bushings mounted about both of the support and steering shafts. The bushings are seated in sockets formed in the axletree for positioning the latter with respect to the frame. Fasteners are provided to secure the bushings on the shaft. The fasteners are adapted to change the steering response or to vary angular orientation of the axletree for purposes of changing the turning radius.

11 Claims, 6 Drawing Figures

WHEEL TRUCK FOR STEERABLE PLATFORM

BACKGROUND OF THE INVENTION

This invention relates in general to wheel trucks for steerable platforms such as skateboards.

Steerable platforms such as skateboards and roller skates have heretofore employed wheel truck designs in which wheels are mounted on a solid axle frame or axletree which in turn is carried below the platform on an inclined steering shaft. The axletree is connected at another point with the platform by a rubber bushing which permits the axletree to pivot about the shaft for steering action.

The prior art wheel truck designs described above have a number of limitations and disadvantages. In a typical truck design the axletree is attached to a steering shaft through a non-yielding connection so as to pivot about a fixed axis. The non-yielding nature of the connection at this critical load point results in a part of the shock forces being carried directly through the wheel truck to the platform, which can result in failure of the component parts. Further, any attempt to vary the angular orientation of the axletree for adjusting the turning radius tends to cause the pivot elements to bind because of the fixed pivot axis connection. Another problem caused by the fixed steering axis connection is that the geometry of the parts causes the wheel truck frame when in operation to exert a large force on the lower support bushing which in turn tends to create undesirable oscillations or wobble.

OBJECTS AND SUMMARY OF INVENTION

It is a general object of the invention to provide a new and improved steerable platform, and to provide a new and improved wheel truck for such a platform.

Another object is to provide a wheel truck of the type described with improved suspension dampening, and which also is more stable and does not create wobble when in use.

Another object is to provide a wheel truck of the type described in which the turning radius and steering response can be easily varied.

Another object is to provide a wheel truck of the type described which achieves improved suspension dampening, stability and adjustment of turning radius and steering response by an assembly comprised of a relatively few number of small and lightweight parts which can be inexpensively fabricated.

The invention in summary includes a wheel truck for a steerable platform such as a skateboard. The wheel truck includes an axletree upon which wheels are rotatably mounted. The axletree is connected by a pair of resilient support means through a base frame which in turn is mounted on the platform. One support means comprises a vertical support shaft about which elastomeric rings are mounted and held in place by fastener means. The other support means comprises a downwardly inclined steering shaft about which elastomeric rings are mounted and held in place by additional fastener means. The sets of rings are seated in recessed sockets formed in the axletree for purposes of positioning the axletree relative to the shafts. The fastener means are adjustable for changing the turning radius and the steering response.

The foregoing and additional objects and features of the invention will appear from the following description in which the preferred embodiments have been set forth in detail in conjunction with the accompanying drawings.

DESCRIPTION OF THE PREFERRED EMBODIMENT

Figure 1:
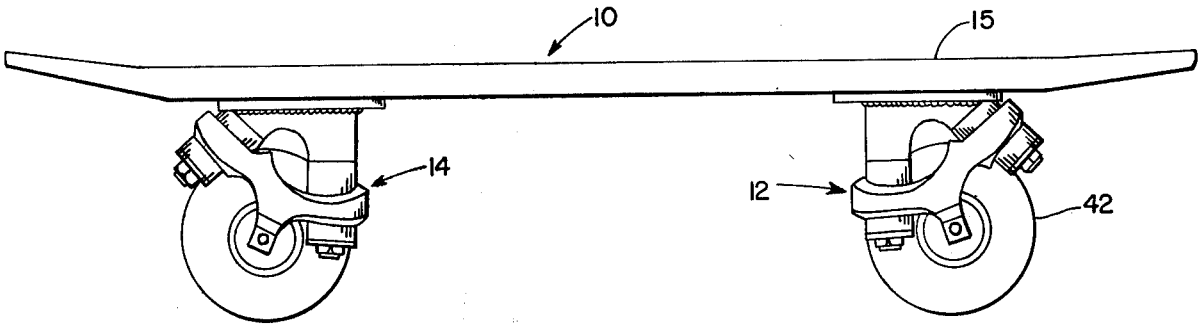
FIG. 1 is a side elevational view of a skateboard incorporating the invention.
Figure 2:
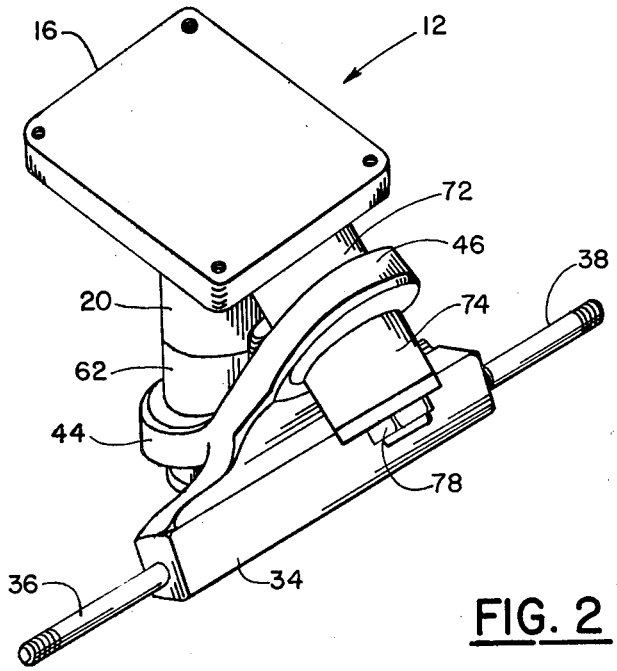
FIG. 2 is a perspective view of a wheel truck employed in the skateboard in FIG. 1.
Figure 3:
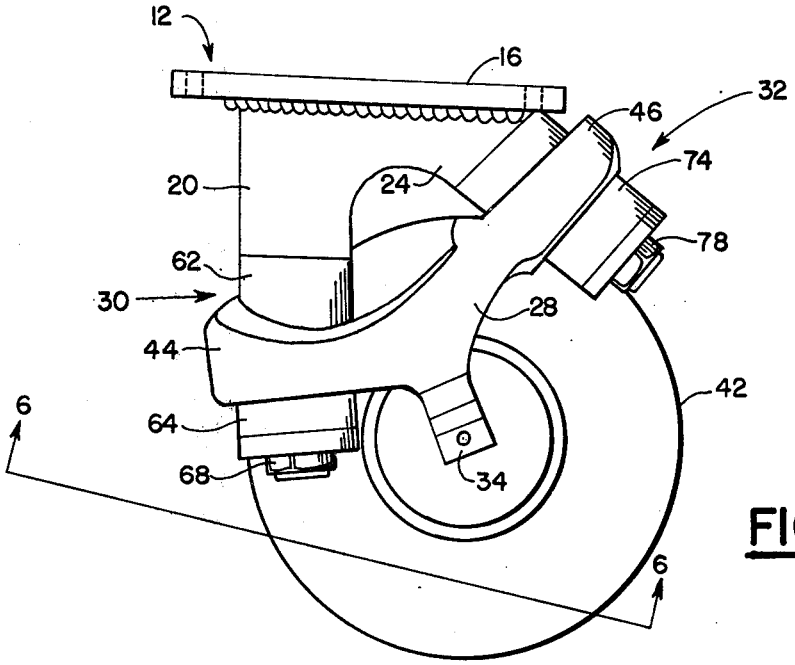
FIG. 3 is a side elevational view of the wheel truck of FIG. 2.
Figure 4:
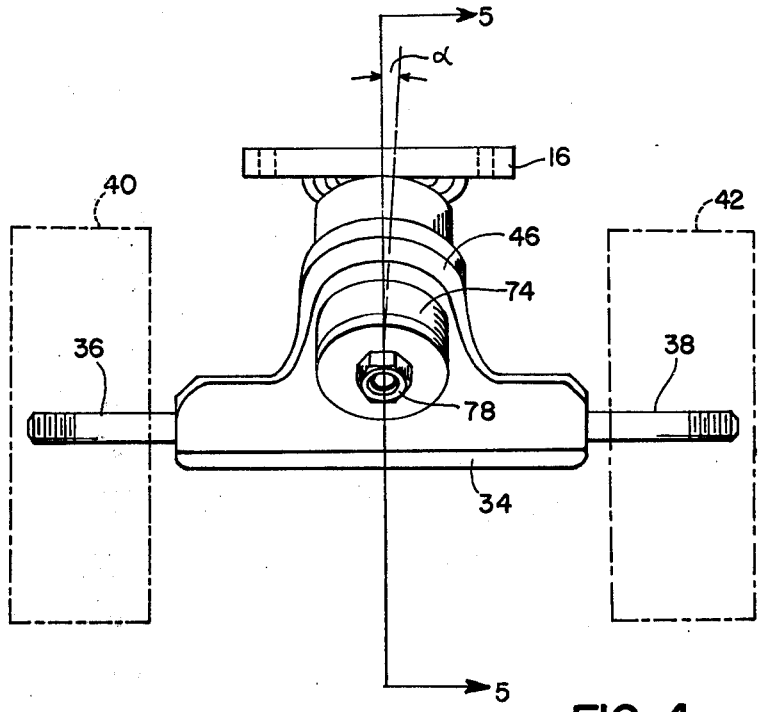
FIG. 4 is a front elevational view of the wheel truck of FIG. 2.
Figure 5:
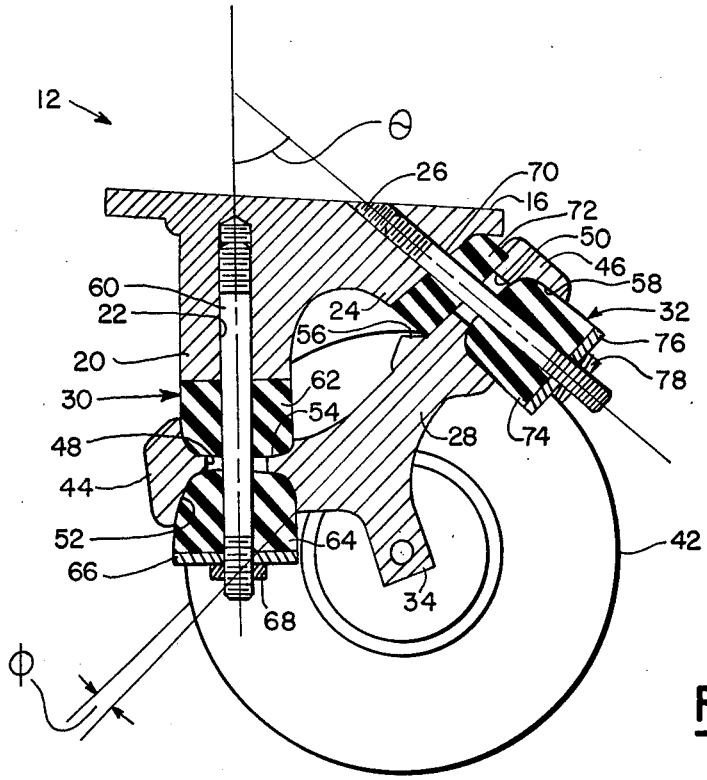
FIG. 5 is a longitudinal section view taken along line 5—5 of FIG. 4.
Figure 6:
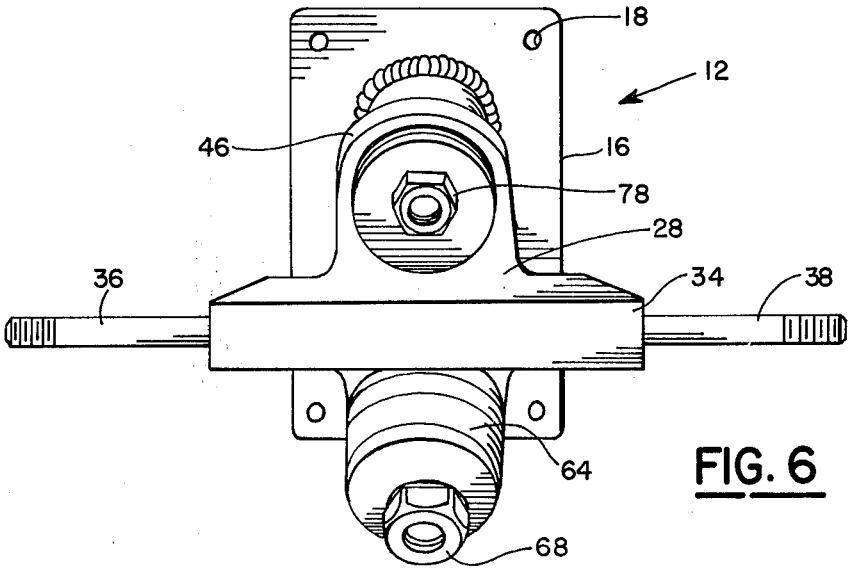
FIG. 6 is an oblique view taken along the line 6—6 of FIG. 3.

In the drawings FIG. 1 illustrates generally at 10 a skateboard incorporating a pair of wheel trucks 12, 14 made in accordance with the invention. While a skateboard is illustrated in the preferred embodiment, it is understood that the invention will also have application with other movable platforms or devices, e.g. roller skates, which are steered by transfer or shifting of weight on the platform.

Skateboard 10 comprises an elongate rigid board 15, formed of a suitable material such as wood or fiberglass, upon which an individual stands. The wheel trucks are mounted at opposite ends of the board to the lower surface.

The wheel trucks preferably are identical in construction and differ only in being mounted on the boards in oppositely-facing directions in the manner shown in FIG. 1. Wheel truck 12 is typical of the two trucks and is illustrated in detail in FIGS. 2–6. The truck includes a base frame 16 which can be machined or cast of a suitable rigid material such as aluminum. Holes 18 are drilled in the corners of the frame for receiving suitable fasteners which attach the frame to the board. The frame is formed with a downwardly directed boss 20 in which a vertical threaded hole 22 is drilled. Another boss 24 formed in the frame is drilled with a threaded hole 26 which inclines at a predetermined angle $\theta$. Preferably the angle $\theta$ is on the order of 30 degrees.

Base frame 16 carries an axletree 28 through first and second resilient support means 30, 32. The axletree can be machined or cast of a suitable rigid material such as aluminum and is formed with a lateral beam 34 the opposite ends of which are drilled with holes in which wheel axles 36, 38 are mounted. A pair of wheels 40, 42 are provided for each truck and the wheels are mounted for rotation on respective axles by suitable fasteners or lock nuts, not shown, carried on the threaded ends of the axles. Where the wheel trucks are employed with a skateboard the wheels preferably are formed of a suitable durable plastics material such as polyurethane and fitted with anti-friction bearings.

Axletree 28 is further formed with an arm 44 which projects horizontally toward the middle of the skateboard together with an arm 46 which projects at an upwardly inclined angle toward the end of the board. The arm 44 is formed with a vertical bore 48 while the arm 46 is formed with an inclined bore 50 disposed at the angle $\theta$ from vertical. Recessed sockets 52, 54 and 56, 58 are formed about the bores in the upper and lower surfaces of the axletree arms.

The first support means 30 includes a support shaft 60 which is threaded at both ends. The proximal end of shaft 60 is threadably mounted in the hole 22 while the distal end of the shaft projects downwardly through axletree bore 48. First support means 30 further includes a pair of elastomeric bushings or rings 62, 64, preferably formed of a suitable material such as hard rubber. The rings are mounted in close-fitting engagement about the shaft on opposite sides of arm 44. The upper surface of ring 62 abuts the end of boss 20 while the lower surface seats within socket 54. The lower ring is seated in socket 52 and is held in place by fastener means shown as a washer 66 and elastic lock nut 68 mounted on the threaded end of the shaft. Seating of the rings within the sockets serves to position the axletree arm in alignment with the support shaft.

Second support means 32 includes a steering shaft 70 the opposite ends of which are threaded. The proximal end of the shaft is threadably mounted in the hole 26 of the frame and the distal end projects through the bore of axletree arm 46. A pair of elastomeric bushings or rings 72, 74, preferably formed of hard rubber, are mounted in close-fitting contact about the shaft on opposite sides of arm 46. One side of ring 72 abuts boss 24 while the other side is seated in socket 56. The opposite ring is seated in socket 58 and is captured in place by suitable fastener means, shown as a washer 76 held in place by elastic stop nut 78 threaded on the end of shaft. The second support means provides sufficient flexibility to permit the axletree to twist to create steering action, with the resiliency of the rings on the support shaft providing sufficient play to permit the axletree to pivot through the angle $\phi$ by adjustment of nut 68 for providing a range of turning radii.

Use and operation of the invention is as follows. When the wheel trucks are employed in a skateboard a pair of the trucks are mounted at oppositely-facing directions with the steering axles at the front and rear trucks extending respectively toward the front and rear of the board 15. In operation, it will be assumed that the skateboard is moving from left-to-right as viewed in FIG. 1. Assuming that the weight is shifted to the left of the direction of movement, or the right-hand side as viewed in FIG. 4, the board and base frame 16 pivot to the right in the Figure through an angle $\alpha$ relative to the axletree and wheels so that a left-hand turn is made by the front truck. At the same time the wheels of the rear truck are caused to turn in an opposite direction so that the wheels of both trucks will track in a curved path.

The employment of resilient support at the steering shaft connections between the axletree and base frame provides greatly increased suspension dampening of the truck as compared to conventional skateboard trucks. That is, the elastic connections at both arms of the axletree provide resilient suspension travel or dampening in a combination of horizontal and vertical directions. The upper rings 72, 74 provide this dampening while at the same time providing a steering pivot axis for the truck. The resiliency provided at this pivot axis also results in more stability as compared to conventional skateboard trucks. This is because the resilient interconnection at the steering axis eliminates the problem of oscillation or wobble which occurs with conventional trucks where the non-yielding steering pivot connection causes the frame to exert a large force on the lower resilient connection.

The employment in the invention of a resilient steering connection between the axletree and frame minimizes a source of potential failure at this critical load point. Shock forces carried between the wheels and skateboard are absorbed by the elasticity of the rings about the steering shaft to obviate the problem of structural failure at this connection. The life of the wheel trucks is thereby prolonged in comparison to conventional skateboards.

The turning radius of the wheel trucks is selectively varied by turning in or out nut 68 on support shaft 60. When the nut is turned in the rings 62, 64 are compressed so that axletree 28 is pivoted toward the frame through an angle $\phi$. This causes the wheel truck to have a smaller turning radius. When the nut is turned out the axletree is pivoted away from the frame by the compressive force of the rings so that the turning radius is increased. This ability to vary the turning radius is achieved without creating any binding between the axletree and steering shaft because of the flexible connection of the elastomeric rings. This is in comparison to conventional skateboard wheel trucks where any tightening of the lower nut would cause the parts to go out of geometry and bind up at the steering axle.

The invention further permits steering responsiveness to be varied as required by particular operating conditions. This is accomplished by turning upper 78 nut in or out along steering shaft 70 to vary the compression on the rings and thereby vary the resistence which the rings have to pivoting of the axletree. The nut 78 would be turned in to tighten the ring where less responsive steering is desired, e.g., for highspeed downhill racing.

Both the upper and lower nuts can be adjusted in combination to effect the desired steering response. For example, both nuts could be turned in to compress both sets of rings so that the axletree is locked-up substantially rigid. A skateboard adjusted in this locked-up mode would have a very low steering response which would be used under conditions such as highspeed, downhill racing.

While the foregoing embodiments are at present considered to be preferred it is understood that numerous variations and modifications may be made therein by those skilled in the art and it is intended to cover in the appended claims all such variations and modifications as followed within the true spirit and scope of the invention.

What is claimed is:

1. A wheel truck for a steerable platform with a base frame carried by the platform, including the combination of an axeltree for mounting wheel means for rotation, first support means for resiliently mounting a first portion of the axeltree on the platform, said first support means including a first shaft mounted on and extending vertically from the frame together with first elastomeric bushing means mounted about the shaft, second support means for resiliently mounting a second portion of the axeltree on the platform, said second support means including a second shaft carried by the frame and inclining downwardly at an angle with respect to the first shaft together with second elastomeric bushing means mounted about the second shaft, said second support means permitting pivotal movement of the axeltree relative to the platform about an axis inclined at an angle from vertical whereby movement of the axeltree about the inclined axis relative to the platform creates a steering action as the platform is rolled on the wheel means over a surface, said first and second support means providing the sole direct connection between the base frame and axeltree, and fastener means for locking the second elastomeric bushing means under a selected compressive force whereby steering responsiveness of the wheel truck can be selectively varied.

2. A wheel truck as in claim 1 in which the second support means includes a shaft together with elastomeric means mounted about the shaft and connected with the axeltree for absorbing shock forces between the wheel means and platform.

3. A wheel truck as in claim 2 in which the elastomeric means is annular with its inner periphery fitted about the shaft and with an end portion carried by the axletree.

4. A wheel truck as in claim 2 which includes means forming a socket recessed in the axletree about the shaft with the elastomeric means seated in the socket for positioning the axletree with respect to the shaft.

5. A wheel truck as in claim 1 in which the first support means includes a shaft carried by the platform and extending along a vertical axis together with elastomeric means mounted about the shaft and connected with the axletree for absorbing shock forces between the wheel means and platform and also for permitting the axletree to pivot about the second support means during said steering action.

6. A wheel truck as in claim 1 in which the first support means includes means for changing the angular orientation of the axletree about a lateral axis relative to the platform whereby said inclined axis is established at a selected angle to provide a range of turning radii for the wheel truck.

7. A wheel truck as in claim 6 in which said means for changing the angular orientation includes a shaft carried by the platform and projecting through the axletree, elastomeric means mounted about the shaft and carried by the axletree, and means for moving the first portion of the axletree along the second support means for causing the axletree to pivot about a lateral axis through the second support means to vary said angular orientation.

8. A wheel truck as in claim 1 in which the platform comprises a skateboard.

9. A wheel truck as in claim 1 which includes fastener means for locking the first elastomeric bushing means under a selected compressive force for changing angular orientation of the axletree about a lateral axis through the second support means to selectively change the turning radius of the wheel truck.

10. A skateboard comprising the combination of an elongate platform, front and rear wheel trucks mounted below opposite ends of the platform, each wheel truck including a base frame, an upright support shaft depending downwardly from the frame, a steering shaft carried by the frame and extending along an axis which inclines at an angle with respect to the support shaft, an axeltree formed with a pair of bores through which the respective support and steering shafts extend, elastomeric bushing means mounted about the shafts for sole direct support between the axeltree and the base frame, wheel means mounted on the axeltree, and the bushing means comprises a pair of rings mounted about each shaft, with one ring of each pair mounted between the axeltree and frame and the other ring of each pair mounted on a side of the axeltree opposite the first ring, together with fastener means for locking the rings and axeltree on the respective shafts.

11. A skateboard as in claim 10 which the includes means for selectively varying the angular orientation of the axletree about a lateral axis for varying the steering radius of the wheel trucks.

* * * * *